United States Patent [19]

Bastenhof

[11] Patent Number: 4,979,244

[45] Date of Patent: Dec. 25, 1990

[54] WAVE VALVE

[76] Inventor: Dirk Bastenhof, Edelvalk 32, 3905 RB Veenendaal, Netherlands

[21] Appl. No.: 471,010

[22] Filed: Jan. 25, 1990

Related U.S. Application Data

[63] Continuation of Ser. No. 198,116, May 24, 1988, abandoned, which is a continuation-in-part of Ser. No. 197,698, May 23, 1988, abandoned.

[51] Int. Cl.[5] ..... A47K 3/10

[52] U.S. Cl. ..... 4/491; 405/79; 137/875

[58] Field of Search ..... 4/491; 137/875; 251/228; 405/79

[56] References Cited

U.S. PATENT DOCUMENTS

| | | | |
|---|---|---|---|
| 3,023,774 | 3/1962 | Schuller | 251/228 X |
| 3,273,854 | 9/1966 | Bryant | 251/228 |
| 3,629,877 | 12/1971 | Schuster | 4/491 |
| 4,351,361 | 9/1982 | Worley | 137/875 X |
| 4,467,483 | 8/1984 | Bastenhof | 4/491 |
| 4,522,535 | 6/1985 | Bastenhof | 4/491 X |
| 4,558,474 | 12/1985 | Bastenhof | 4/491 |
| 4,575,500 | 5/1985 | Bastenhof | 4/491 X |
| 4,718,457 | 1/1988 | Luger | 137/875 |
| 4,720,210 | 1/1988 | Stonor et al. | 4/491 X |
| 4,730,355 | 3/1988 | Kreinbihl et al. | 4/491 |
| 4,755,095 | 7/1988 | Mailliet et al. | 251/228 |

FOREIGN PATENT DOCUMENTS 7000174 7/1970 Netherlands .

*Primary Examiner*—Charles E. Phillips
*Attorney, Agent, or Firm*—Heslin & Rothenberg

[57] ABSTRACT

A pneumatic wave-generator for a wave pool, comprising a caisson divided into a plurality of wave-generating chambers, a ventilator space provided with a powered source of forced air, and a system of conduits coupled to an air-directional valve which is capable of effecting forced aspiration and expiration above the water surfaces in the wave-generating chambers. The air-directional valve efficiently and selectively directs air into and out of a chamber, as desired, provides a seal against the unwanted flow of air, has a reduced number of moving pieces, is mechanically efficient, and has limited wear points.

18 Claims, 3 Drawing Sheets

25
44
40
48
45
60
46
102
61
100
50
61
53
52
104
70
26
43
102
100
100
58
54
62
64
56
42
68
66
14

44
40
45
60
100
61
48
46
102
50
61
53
52
26
100
104
102
100
58
54
64
62
42
56
68
66
14

WAVE VALVE

This application is a continuation of application Ser. No. 07/198,116, filed May 24, 1988 now abandoned, which is a continuation-in-part of Ser. No. 07/197,698, filed May 23, 1988, now abandoned.

FIELD OF THE INVENTION

This invention relates to a pneumatic wave-generator for a swimming pool.

BACKGROUND OF THE INVENTION

Pneumatic wave-generators are known in the art and are typically employed for creating various wave patterns in a water-filled wave-pool. Such wave-pools have become very popular at water amusement parks and municipal parks in the United States, as well as in foreign countries.

Known wave-pools generally comprise a caisson structure located at one end of a long swimming pool. The caisson structure is divided into a plurality of wave-generating chambers. These chambers are aligned side-by-side across the end of the pool. Each chamber is sealed except for a below-the-water passageway into the pool, and a valve assembly above the water line to selectively admit pressurized air into the chamber. Forced air, as from a motor-driven blower, is directed into various of the chambers through the valve assembly, forcing water downwardly into the chambers and through the below-the-water passageway so as create waves in the pool. After pressurization of a chamber, the air must be vented out to allow water to return to its normal level in the chamber.

Different wave patterns may be created by forcing air into the chambers in various combinations and sequences. This is achieved, in part, by controlling the valves into the various chambers.

Schuster al. U.S. Pat. No. 3,629,877 discloses a wave-pool having a plurality of chambers and an air-directing valve arrangement for forcing air into the chambers for creating waves in the pool. The Schuster air-directing valve arrangement includes a two-way valve device which connects a source of forced air to two adjacent wave-generating chambers in a fixed relationship. Each chamber has an inlet-outlet passageway for receiving air by way of the valve arrangement and for exhausting air into the surrounding atmosphere, typically in an equipment room. The Schuster two-way valve arrangement directs air into one of the two adjacent chambers while exhausting air from the other of the adjacent chambers. This arrangement does not allow the forcing of air into both chambers simultaneously, and thus limits the combinations of wave patterns that may be generated.

Another pneumatic wave-generator takes the form illustrated in the Bastenhof U.S. Pat. Nos. 4,467,483 and 4,558,474. The particular valve device disclosed in the Bastenhof patents includes air inlet and air outlet openings coupled together with a common drive. Bastenhof permits pressurization of all the wave-generating chambers in any order or pattern, including simultaneous pressurization. Bastenhof also discloses the use of a common plenum to connect two or more valves to one source of forced air.

Kreinbuhl et al. U.S. Pat. No. 4,730,355, discloses yet another form of wave-generator. In Kreinbuhl, a four-way air-directional valve assembly connects a source of forced air to associated pairs of inlet-outlet passageways communicating with adjacent wave chambers. The valve in Kreinbuhl permits four conditions: (a) air can be directed into both adjacent chambers simultaneously; (b) air can be directed into one chamber while the other chamber is exhausted; (c) the opposite of (b); or (d) air can be exhausted from both chambers.

As can be seen from the above-referenced art, each of these systems have a substantial amount of equipment and moving parts, and there are often large forces on the parts which increase their wear and reduce their life. Because maintenance and repair is of significant concern to water-park operators, it is important to minimize the number of moving parts employed for creating the various wave patterns, and to reduce wear and tear on those parts which do move thereby improving reliability and simplifying maintenance. In addition, to reduce operating costs, it is desirable to have a system which efficiently controls and directs air into the wave chambers.

SUMMARY OF THE INVENTION

In accordance with the present invention, an apparatus is provided for pneumatically generating waves in a wave-pool having a plurality of wave-generating chambers arranged side-by-side or in a staggered position and extending across the width of the pool at one end. An improved valving means is provided which connects a source of forced air to a wave-generating chamber.

The improved valving means has a single pivoting valve face which is controlled by a pneumatic or hydraulic cylinder and sealed within a valve housing assembly that has three paths--air inlet, air outlet and wave chamber. The single face can selectively cover and seal the air inlet or air outlet. When it is desired to have air blown into a chamber, the cylinder is moved into its retracted condition, which puts the face into a state which blocks the exhaust outlet, and which directs the forced air into the wave chamber. When air is not to be blown into a chamber, the cylinder is extended, and the face is moved to a second state which closes the air inlet opening and permits air in the wave chamber to exit through the exhaust outlet. Air-directional vanes may be provided in the opening to the wave chamber to provide for efficient air flow into the chamber during the face's transition between opened and closed states.

The improved valve assembly disclosed herein thus uses only one moving valve face to control both input and exhaust states, and does not bear against any structures other than the inlet and outlet seats. The input state provides for efficient air flow from the source into a wave chamber in the caisson. The exhaust state provides an exhaust flow from the wave chamber, while keeping the forced air out of the chamber. In addition, because of the relationship of the valve face to the openings, the pressure from the forced air will blow the valve face away from the inlet seal and hold it in place against the exhaust outlet seal, thus necessitating only a one-way cylinder, and consequently reducing the system's complexity.

DESCRIPTION OF THE DRAWINGS

The invention will be more fully understood from the following solely exemplary detailed description, taken in conjunction with the accompanying drawings in which.

DETAILED DESCRIPTION OF THE INVENTION

Figure 1:
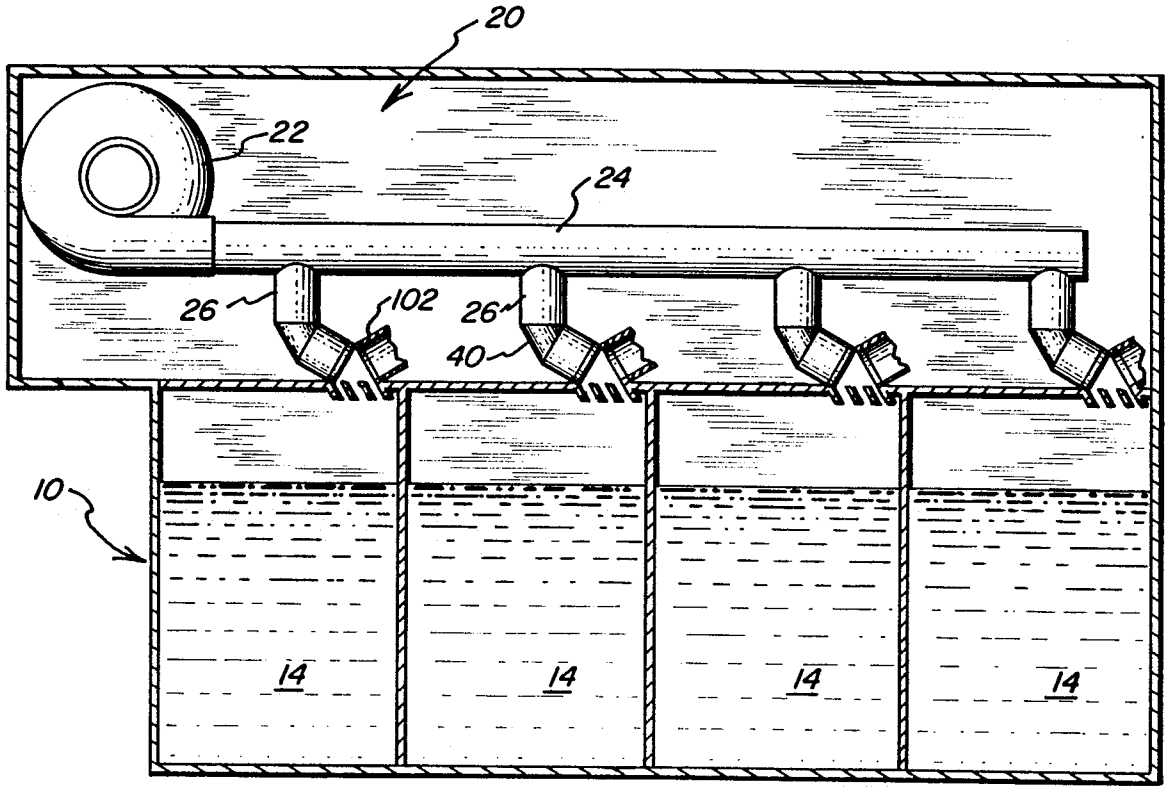
FIG. 1 is a diagram representation of a wave-pool having the wave-generating equipment of the present invention.

The wave-generator equipment of FIG. 1 comprises a caisson 10 and a ventilator space or equipment room 20. Caisson 10 is divided by a plurality of partitions 12 into wave-generating chambers 14. Each chamber has a below the water opening not shown into an associated swimming pool. Ventilator space 20 includes a blower 22 supplying forced air to a duct 24 having branches 26 which connect duct 24 to air-directional valves 40. In the preferred embodiment, there is one branch 26 and one valve 40 for each wave-generating chamber. In other instances, however, more than one branch may terminate in one chamber, or duct 24 can be eliminated and the source of forced air directly connected to each chamber through a valve. Each valve is independently or selectively controlled by pneumatic or hydraulic control lines 25 (See FIG. 2) from a controller (not shown).

Each of the air-directional valves 40 is located above the normal water level in the wave-generating chamber 14, so as to be able to force the water in the chamber downwards and out of the chamber via an opening (not shown) when the valve is "open." In FIG. 1, the valves 40 are shown fixed to the floor of the ventilator space 20, but in alternative embodiments, the valves may be affixed to the chamber wall at an appropriate height.

Each of the valves 40 is independently controlled so that air can be selectively directed into any one or more of the wave-generating chambers 14, in any selected sequence. The sequence of aspiration and expiration, including the timing in which this is effected, is controlled by a controller (not shown) opening and closing the valves 40 at each of the different chambers in the particular sequence and timing desired. For example, adjacent chambers can be alternately supplied with air to provide a complex wave configuration resulting from two diagonally travelling wave fronts. Other wave shapes and directions can be provided by introducing air into the chambers 14 in various other sequences.

Figure 2:
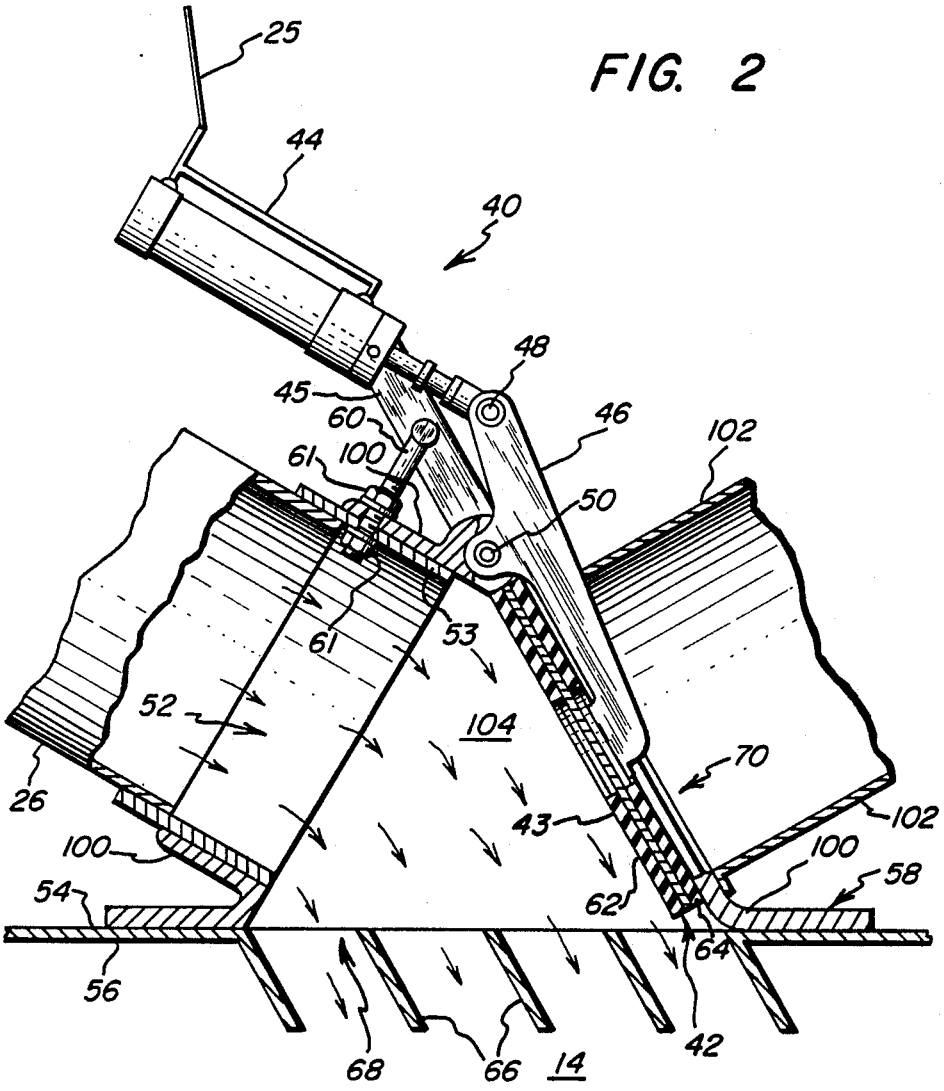
FIG. 2 is a sectional view with parts broken away of the valve assembly of the invention in the forced air entry position.
Figure 3:
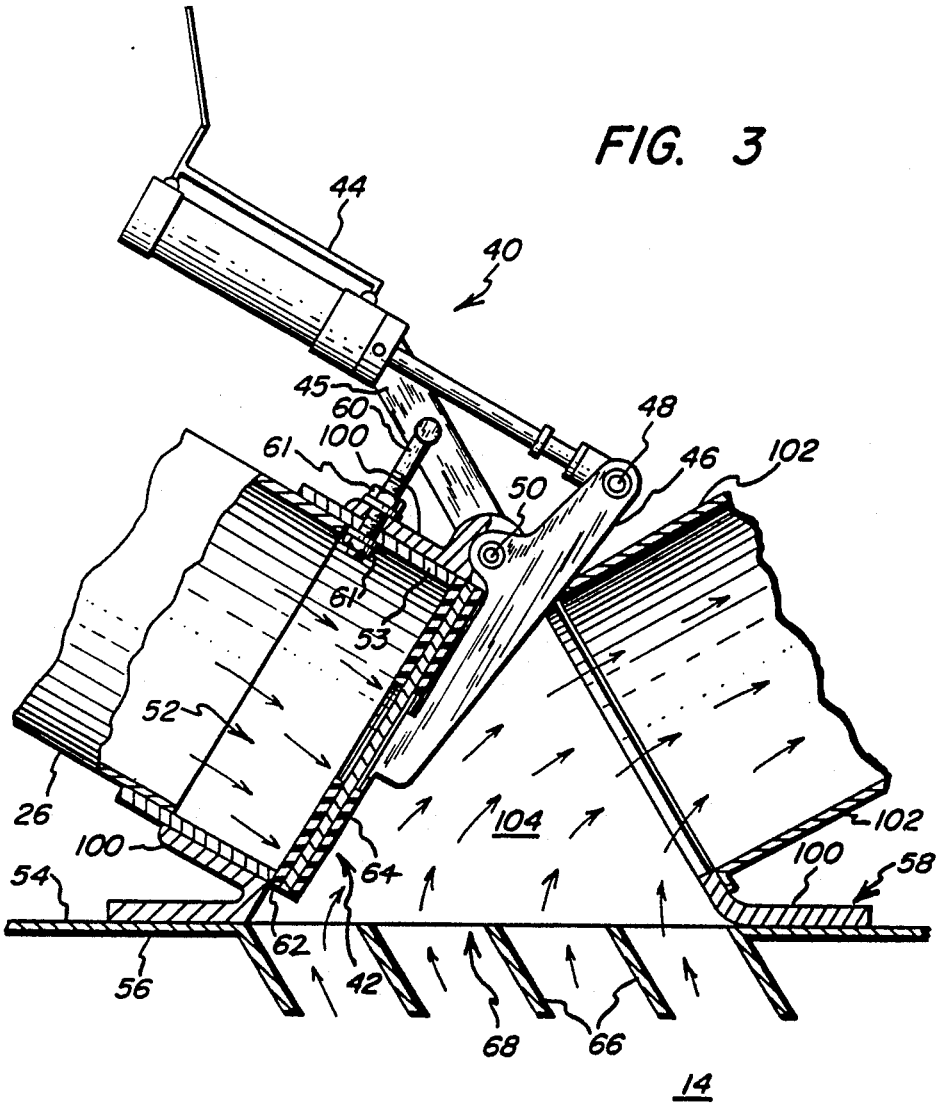
FIG. 3 is a sectional view with parts broken away of the valve assembly of the invention in the exhaust position.

FIGS. 2 and 3 show a preferred embodiment of an air-directional valve 40 in the opened (air input) and closed (exhaust) position, respectively. The valve assembly of FIGS. 2 and 3 comprises a housing 100 that includes three triangularly arrayed ports. An inlet port 52 along one housing side is defined by a sleeve 53 into which fits forced air duct 26. An exhaust duct 102 is bolted to housing 100 along a second side. The third part is an opening of the housing 100 bordered by flanges 56 and 58 of the housing. The housing 100 includes front and back plates 104 that seal the housing except at the three ports.

To produce the "opened" and "closed" states, the valve assembly 40 has a valve face 42 controlled by a single pneumatic or hydraulic cylinder 44. The cylinder 44 is connected to the face 42 by means of a rocker arm 46 fixed to the face 42. Rocker arm 46 is mounted to the valve 40 at pivot 50 comprising a pivot pin and bearing, and is connected to the cylinder 44 at a pivot 48. The arm 46 and bearing 50 are close enough to seal the housing where they pass through it. The active end of pneumatic cylinder 44 is attached to a link 45 angled about pivot 50 by an adjustable strut 60, adjusted by nuts 61 tightened around housing 100 and sleeve 53. The entire valve is connected to the floor or a wall of the swimming pool by flanges 56 and 58.

Cylinder 44 fed from line 25 controls operation of the valve face 42. The control of the cylinder itself can be effected, for example, electronically by means of a computer with the controller (not shown). The manner of controlling a cylinder by computer is known by those skilled in the art, and therefore needs no further description herein.

When it is desired to open the valve, the cylinder 44 is retracted to move the valve face 42 to cover the air exhaust opening 70. When the valve is "open," the air in duct branch 26 passes through the air inlet 52 formed by manifold 53, and is blown into pool chamber 14 through opening 68. When it is desired to close the valve, cylinder 44 is extended and, as shown in FIG. 3, the valve face 42 is moved to block the air inlet opening 52.

Cylinder 44 can be either a two-way cylinder which provides force in both its directions of movement, or a one-way cylinder which provides force in only one of its directions. A one-way cylinder may be used with the present invention because the force of the air in duct branch 26 will, when the cylinder is deactivated, blow the valve face against exhaust opening 70 and hold it there. A one-way cylinder permits cheaper and easier control of the valve.

The opening 68 into the pool chamber 14 can be divided by a plurality of air-directing vanes 66 along its length. These vanes 66 lengthen the short-circuit air path between the air inlet opening 52 and the air exhaust opening 70, and thus enable more air to be blown directly into the caisson chamber 14 during the intermediate stages of opening and closing of the valve face. The air-directional vanes 66 reduce leakage when the valve is in its mid-position as compared to other valves, where more air flows out the exhaust opening during valve transition than into the wave chamber.

It will be appreciated that the disclosed valve 40 provides better air flow for and less resistance to the air blowing into the caisson chambers 14. In particular, there are no obstructions in the air flow path which interfere with the forced air. This allows for higher efficiencies during operation.

The disclosed valve is also easy to install and maintain. The valve can be pre-assembled away from the site of the pool, such as at a factory, and can then be fastened to the wall or floor of a swimming pool by bolts through mounting flanges 56 and 58.

Because each valve has only one valve face, there are fewer moving parts to maintain. In addition, there is only one major wear point on each valve, at bearing 50, and this is easy to access and replace. There is also wear at bearing 48. The valve's relative arrangement of parts prevents any perpendicular forces on the cylinder, and thus reduces the side and lateral loading on the cylinder. Due to the relative arrangement of the cylinder, valve face and air exhaust opening, the power necessary to operate the valve is greatly reduced because the air pressure is effective to blow the valve face into the open position In a typical embodiment of the disclosed valve, the pressure on the cylinder is approximately 55 to 60 pounds, and the air openings are between 12 and 16 inches in diameter. It will be evident that these dimensions and specifications are exemplary only. While the air inlet and outlet openings are shown in FIGS. 2 and 3 to be circular, they can be of any shape, including rectangular. To provide optimum air flow, the air inlet opening, the exhaust opening and the chamber opening are each approximately of equal cross-sectional size, and the angles between them are approximately 60 degrees each.

The valve can be made of any rigid material, such as fiberglass or stainless steel. The valve face 42 is preferably made with a polyvinylchloride (PVC) or stainless steel center plate 43, which provides rigidity. Rubber seals 62 and 64 are adhered to opposite sides of the center plate 43 to provide a good seal between the assembled valve face 42 and the air inlet opening 52 and the air exhaust opening 70.

As is apparent from the present description, other modifications and alternative implementations will occur to those versed in the art without departing from the true spirit and scope of the invention. Accordingly, it is not intended to limit the invention to what has been particularly shown and described except as indicated in the appended claims.

What is claimed is:

1. Apparatus for pneumatically generating waves in a wave pool having water therein comprising:

at least one wave-generating chamber arranged across said pool at one end thereof wherein each said wave chamber has a below the water passageway in communication with said pool and a sealed portion extending above a normal water level of said pool, each said chamber having an opening into said chamber above said water level, said opening serving in one mode as an inlet for receiving forced air and in the second mode as an outlet for exhausting air from said chamber;

a source of forced air;

at least one valve housing for each chamber having a source port, an exhaust port and a wave chamber port arranged on complementary sides of a triangular pattern, the base of said triangular pattern including said chamber port and said housing being sealably mounted on said chamber opening with its chamber port in communication with said opening and said source port being in sealed communication with the forced air source;

each said housing including a valve face pivoted at one end to move between a first position wherein said face seats on and seals said exhaust port, and a second position wherein said face seats on and seals said source port, said valve face being pivoted near the apex of the triangular pattern; and means for moving said valve face between said first position and said second position, said source port being in communication with said chamber port when said valve face is in said first position such that air is input to said chamber and said exhaust port being in communication with said chamber port when said valve face is in said second position such that air is exhausted from said chamber.

2. The apparatus of claim 1 wherein said source port, said exhaust port and said wave chamber port are of approximately equal cross-sectional area and the angles therebetween are approximately 60°.

3. The apparatus of claim 2 wherein the openings defined by said source port, said exhaust port and said wave chamber port substantially comprise the sides of said triangular pattern.

4. The apparatus of claim 1 further including air-directional vanes in said opening to said wave-generating chamber.

5. The apparatus in claim 1 in which said means for moving said valve face comprise:

a rocker arm pivoting about a pivot and attached at one end to said valve face; and an activator attached to an opposite end of said rocker arm and adapted to move said valve face via said rocker arm between said first and second position.

6. The apparatus of claim 5 wherein said valve face pivots on a first bearing and is controlled by said activator attached to a second bearing.

7. The apparatus of claim 6 wherein said valve face comprises a rigid center piece of cross-sectional area greater than the larger of the cross-sectional area of said source port and said exhaust port, and wherein a flexible resilient material is affixed to the perimeter of the front and back sides of said valve face to provide a seal around said openings.

8. The apparatus of claim 7 wherein said activator is a one-way cylinder and is placed into its retracted condition by means of air pressure against said valve face.

9. A pneumatic wave-generator for a surf pool, comprising a caisson divided into a plurality of wave-generating chambers, and a source of forced air capable of effecting aspiration by applying compressed air to the space above the water surfaces in the wave-generating chamber via a conduit system provided with an air-directional valve, wherein said air-directional valve comprises:

a valve housing sealably mounted to each wave-generator chamber and having a source port with a first cross-sectional area that receives air from said source of forced air;

an opening into said wave-generating chamber with a second cross-sectional area to receive said air from said source port; and an exhaust port with a third cross-sectional area to exhaust air from said wave-generating chamber;

said first, second and third cross-sectional areas being defined on complementary sides of a triangular pattern;

a valve face of cross-sectional area slightly greater than the larger of the first or third cross-sectional areas of the source port and exhaust port, respectively; and means for pivoting said valve face between a first position in which said face seats on and seals said exhaust duct and a second position wherein said face seats on and seals said source port, said source port being in communication with said chamber opening when said value face is in said first position such that air is input to said chamber, and said exhaust port being in communication with said chamber opening when said valve face is in said second position such that air is exhausted from said chamber, and said valve face being pivoted at one end near the apex of the triangular pattern.

10. The apparatus in claim 9 in which said means for moving said valve face comprise:

a rocker arm pivoting about a pivot and attached at one end to said valve face; and an activator attached to an opposite end of said rocker arm and adapted to move said valve face via said rocker arm between said first and second position.

11. The wave-generator of claim 9 wherein said first, second and third cross-sectional areas are of approximately equal size and the angles therebetween are approximately 60°.

12. The wave-generator of claim 11 wherein said first, second and third cross-sectional areas substantially comprise the sides of said triangular pattern.

13. A valve assembly for a wave-generator comprising:

a housing having a source port, an exhaust port and a wave chamber port arranged on complementary sides of a triangular pattern;

a valve face pivoted at one end to move between a first position wherein said face seats on and seals said exhaust port, and a second position wherein said face seats on and seals said source port, said valve face being pivoted near the apex of the triangular pattern;

means for moving said valve face between said first position and said second position, said source port being in communication with said chamber port when said value face is in said first position such that when said value is mounted to a wave-generating chamber air is input to said chamber, and said exhaust port being in communication with said chamber port when said valve face is in said second position such that when said valve is mounted to a wave-generating chamber air is exhausted from said chamber; and said housing being adapted for mounting to a wave-generator chamber with said chamber port in communication with the interior of said chamber.

14. The valve of claim 13 wherein vanes are located in said wave chamber port angled against the flow of air from said wave chamber port into said exhaust port, and with the flow from said source port into said wave chamber port.

15. The apparatus in claim 13 in which said means for moving said valve face comprise:

a rocker arm pivoting about a pivot and attached at one end to said valve face; and an activator attached to an opposite end of said rocker arm and adapted to move said valve face via said rocker arm between first and second position.

16. The valve of claim 15 including means for adjusting said activator.

17. The valve assembly of claim 13 wherein said source port, said exhaust port and said wave chamber port are of approximately equal cross-sectional area and the angles therebetween are approximately 60°.

18. The valve assembly of claim 17 wherein the openings defined by said source port, said exhaust port and said wave chamber port substantially comprise the sides of said triangular pattern.

* * * * *

UNITED STATES PATENT AND TRADEMARK OFFICE

CERTIFICATE OF CORRECTION

PATENT NO. : 4,979,244

DATED : December 25, 1990

INVENTOR(S) : Bastenhof, Dirk

It is certified that error appears in the above-identified patent and that said Letters Patent is hereby corrected as shown below:

Column 6, line 24, substitute --5-- for "7"

Column 8, line 18, substitute --positions-- for "position"

Signed and Sealed this

Twenty-fifth Day of August, 1992

*Attest:*

DOUGLAS B. COMER

*Attesting Officer*

*Acting Commissioner of Patents and Trademarks*